US008723733B2

(12) United States Patent
Tran et al.

(10) Patent No.: US 8,723,733 B2
(45) Date of Patent: May 13, 2014

(54) MULTIBAND ANTENNA FOR A MOBILE DEVICE

(75) Inventors: Allen M. Tran, San Diego, CA (US); Jatupum Jenwatanavet, San Diego, CA (US); Joe C. Le, Poway, CA (US)

(73) Assignee: QUALCOMM Incorporated, San Diego, CA (US)

( * ) Notice: Subject to any disclaimer, the term of this patent is extended or adjusted under 35 U.S.C. 154(b) by 420 days.

(21) Appl. No.: 13/077,039

(22) Filed: Mar. 31, 2011

(65) Prior Publication Data

US 2012/0076184 A1 Mar. 29, 2012

Related U.S. Application Data

(60) Provisional application No. 61/387,954, filed on Sep. 29, 2010.

(51) Int. Cl.
*H01Q 1/38* (2006.01)

(52) U.S. Cl.
USPC ..... 343/700 MS; 343/893

(58) Field of Classification Search
USPC ..... 343/700 MS, 893, 702
See application file for complete search history.

(56) References Cited

U.S. PATENT DOCUMENTS

| | | | | |
|---|---|---|---|---|
| 6,342,859 | B1 | 1/2002 | Kurz et al. | |
| 6,717,551 | B1 | 4/2004 | Desclos et al. | |
| 7,423,592 | B2 | 9/2008 | Pros et al. | |
| 7,612,725 | B2 | 11/2009 | Hill et al. | |
| 2003/0216150 | A1 | 11/2003 | Ueda | |
| 2004/0137950 | A1 | 7/2004 | Bolin et al. | |
| 2007/0159398 | A1 | 7/2007 | Tsai et al. | |
| 2008/0136716 | A1* | 6/2008 | Annamaa et al. | 343/702 |
| 2009/0174611 | A1 | 7/2009 | Schlub et al. | |
| 2009/0289844 | A1 | 11/2009 | Palsgrove et al. | |
| 2009/0289859 | A1* | 11/2009 | Pan | 343/702 |
| 2009/0295660 | A1 | 12/2009 | Xu et al. | |
| 2009/0325655 | A1 | 12/2009 | Sato et al. | |
| 2010/0103069 | A1 | 4/2010 | Wang et al. | |
| 2010/0221870 | A1 | 9/2010 | Maekawa et al. | |
| 2011/0175776 | A1* | 7/2011 | Anguera et al. | 343/700 MS |
| 2012/0230377 | A1 | 9/2012 | Jenwatanavet et al. | |

FOREIGN PATENT DOCUMENTS

| | | |
|---|---|---|
| AU | 2008207406 | 11/2010 |
| WO | WO2006031170 A1 | 3/2006 |

OTHER PUBLICATIONS

Chou, et al., "Internal Multiband Antenna for WLAN/WiMAX Dual-Network Operation for Laptop Applications". International Symposium on Antennas and Propagation [Online] 2006.

(Continued)

*Primary Examiner* — Ahshik Kim
(74) *Attorney, Agent, or Firm* — Mary A. Fales

(57) ABSTRACT

A multiband antenna for a mobile device is disclosed. The mobile device includes a multiband antenna configured to communicate with a base station. The multiband antenna includes a ground plane, a ground plane extension, and a plurality of antenna arms. The ground plane, the ground plane extension, and the plurality of antenna arms are configured to communicate signals in multiple frequency bands, where the ground plane and the ground plane extension have a length proportional to approximately a quarter wavelength of a frequency in the multiple frequency bands. The mobile device further includes a modulator and demodulator configured to modulate signal for transmission and demodulate signal received from the base station, and a controller configured to control communication of signals using the multiband antenna and the modem.

8 Claims, 9 Drawing Sheets

(56) References Cited

OTHER PUBLICATIONS

Huang C-U et al., "2.4 and 5.2 Ghz Dual-Band Antenna Fabricated on Flexible Parylene Membrane". Japanese Journal of Applied Physics, JP, vol. 44, No. 12, Dec. 8, 2005, pp. 8356-8361, XP001502391. ISSN: 0021-4922. DOI: 10.1143/JJAP.44.8356 abstract; figure 1.
International Search Report and Written Opinion—PCT/US2011/054044—ISA/EPO—Jan. 17, 2012.
Junho Yeo et al., "Design of antennas for a battery-assisted RFID tag with a thin and flexible film battery". Antennas and Propagation International Symposium, 2007 IEEE, IEEE, Piscataway, NJ, USA, Jun. 1, 2007, pp. 5463-5466, XP031170428. DOI: 10.1109/APS.2007.4396784 ISBN: 978-1-4244-0877-1 the whole document.
Lakafosis V et al., "Progress Towards the First Wireless Sensor Networks Consisting of Inkjet-Printed, Paper-Based RFID-Enabled Sensor Tags", Proceedings of the IEEE, IEEE. New York, US, vol. 98, No. 9, Sep. 1, 2010. pp. 1601-1609. XP011312405, ISSN: 0018-9219 abstract; figure 7.
Peter Hoogeboom et al., "Development of a switching passive 2.4 GHz RFID transponder on flexible substrate", Microwave Conference, 2809. EUMC 2009. European IEEE Piscataway NJ USA, Sep. 29, 2009 pp. 165-168. XP831669866 ISBN: 978-1-4244-4748-8 * Section V. Transponder Realization.
Rida A et al., "Broadband UHF RFID/sensor modules for pervasive cognition applications". 3rd European Conference on Antennas and Propagation. EUCAP 2009, Mar. 23-27, 2009—Berlin. Germany. IEEE. Piscataway. NJ. USA. Mar. 23, 2009. pp. 2344-2347. XP031470260. ISBN: 978-14244-4753-4 Abstract and Section IV Double Layer monopole antenna on paperfigure 2.
Ma at al. "A wearable Flexible Multi-Band Antenna Based an a Square Slotted Printed Monopole." 2008 Loughborough Antennas & Propagation Conference [Online]. Mar. 17-18, 2008, pp. 345-348, Loughborough , UK.
Lai, et al. "Slot Antennas With an Extended Ground for Multiple-Antenna Systems in Compact Wireless Devices," IEEE Antennas and Wireless Propagation Letters, vol. 8, 2009, pp. 19-22.
Gupta et al. "Printed TRI-Band Monopole antenna Structures for Wireless Applications," Terna Engineering College, vol. 1, Issue 2, Apr.-Jun. 2010, pp. 1-7.

* cited by examiner

MULTIBAND ANTENNA FOR A MOBILE DEVICE

CROSS REFERENCE TO RELATED APPLICATIONS

This application claims benefit of U.S. provisional application bearing Ser. No. 61/387,954, "Multi-band Antenna for Pet and Person Tracking Device," filed Sep. 29, 2010, assigned to the assignee hereof. The aforementioned United States application is hereby incorporated by reference in its entirety.

FIELD

The present disclosure relates to the field of wireless communications. In particular, the present disclosure relates to a multiband antenna for a mobile device.

BACKGROUND

Various types of mobile devices have been used for communication among people or for location monitoring applications. For example, a conventional cellular phone can be used for voice and data communication. A conventional global positioning system (GPS) watch can be used for navigation in the mountains. In such conventional devices, the antenna is embedded within the enclosure of the cellular phone or the GPS watch, and the ground plane of the antenna is typically shared with the ground plane of the printed circuit board of the device. One of the drawbacks of such conventional devices is that the signal quality of the antenna is limited because of the small size of the printed circuit board enclosed within the enclosure of the devices. Another drawback of the conventional devices is that the signal quality of the antenna may be adversely affected by the electrical characteristics of the printed circuit board because it shares the electrical ground with other components on the printed circuit board.

Therefore, there is a need for multiband antenna for a mobile device that can address the above issues of conventional mobile devices.

SUMMARY

The present disclosure relates to multiband antenna for a mobile device. In one embodiment, the multiband antenna includes a ground plane, a ground plane extension, and a plurality of antenna arms. The ground plane, the ground plane extension, and the plurality of antenna arms are configured to communicate signals in multiple frequency bands, where the ground plane and the ground plane extension have a length proportional to approximately a quarter wavelength of a frequency in the multiple frequency bands. In one implementation, the ground plane, the ground plane extension, and the plurality of antenna arms are made by applying conductive ink on at least one of plastic or rubber carrier. In an alternative implementation, the ground plane, the ground plane extension, and the plurality of antenna arms are made with stamped metal parts heat-staked to a plastic carrier or mold-injected into a rubber carrier.

In one approach, the ground plane is located in a first enclosure; the ground plane extension and the plurality of antenna arms are located in a second enclosure. The second enclosure can be configured to create a separation between the multiband antenna and a user. The first enclosure of the multiband antenna includes a printed circuit board, and the ground plane of the multiband antenna is used as an additional shield for the printed circuit board. In an alternative embodiment, a ground plane of the printed circuit board is used as part of the ground plane of the multiband antenna. In some implementations, the ground plane and the ground plane extension are directly connected. In some other implementations, the ground plane and the ground plane extension are coupled to each other through one or more controllable connectors, where the one or more controllable connectors are configured to connect or disconnect the ground plane extension from the ground plane.

In some implementations, the ground plane, the ground plane extension and the plurality of antenna arms are etched on a flexible material. Then, a first section of the flexible material including the ground plane is placed into the first enclosure, a second section of the flexible material including the ground plane extension and a third section of the flexible material including the plurality of antenna arms are molded into a thermoplastic elastomer of the second enclosure. The flexible material includes a polyimide film having a dielectric constant of 3.6 at 1 MHz, and a loss tangent of 0.02 at 1 MHz; and the thermoplastic elastomer material having a dielectric constant in the range of 2.0 to 3.5 and a loss tangent in the range of 0.005 to 0.019 at 1 MHz.

The plurality of antenna arms includes a first antenna arm configured to communicate signals in a first frequency band, a second antenna arm configured to communicate signals in a second frequency band, and a third antenna arm configured to communicate signals in a third frequency band. The first frequency band includes Cell and industrial, scientific and medical (ISM) bands, and the first antenna arm has a length proportional to approximately a quarter wavelength of a frequency in the Cell and ISM bands. The second frequency band includes GPS band, and the second antenna arm has a length proportional to approximately a quarter wavelength of a frequency in the GPS band. The third frequency band includes personal communication service (PCS) band, and the third antenna arm has a length proportional to approximately a quarter wavelength of a frequency in the PCS band.

In another embodiment, a mobile device includes a multiband antenna configured to communicate with a base station, where the multiband antenna includes a ground plane, a ground plane extension, and a plurality of antenna arms. The ground plane, the ground plane extension, and the plurality of antenna arms are configured to communicate signals in multiple frequency bands, where the ground plane and the ground plane extension have a length proportional to approximately a quarter wavelength of a frequency in the multiple frequency bands. The mobile device further includes a modem (modulator and demodulator) configured to modulate signal for transmission and demodulate signal received from the base station, and a controller configured to control communication of signals using the multiband antenna and the modem. In one exemplary implementation, the ground plane is located in a first enclosure, the ground plane extension is located in a second enclosure, and the plurality of antenna arms is located in a third enclosure.

The first enclosure of the mobile device includes a printed circuit board, and the ground plane of the multiband antenna is used as an additional shield for the printed circuit board. In an alternative embodiment, a ground plane of the printed circuit board is used as part of the ground plane of the multiband antenna. The second enclosure and third enclosure of the mobile device are configured to create a separation between the multiband antenna and a user. In some implementations, the ground plane and the ground plane extension are directly connected. In some other implementations, the ground plane and the ground plane extension are coupled to each other through one or more controllable connectors, wherein the one or more controllable connectors are configured to connect or disconnect the ground plane extension from the ground plane.

In some implementations, the ground plane, the ground plane extension and the plurality of antenna arms are etched on a flexible material. Then, a first section of the flexible material including the ground plane is placed into the first enclosure, a second section of the flexible material including the ground plane extension is molded into a thermoplastic elastomer of the second enclosure, and a third section of the flexible material including the plurality of antenna arms is molded into a thermoplastic elastomer of the third enclosure. The flexible material includes a polyimide film having a dielectric constant of 3.6 at 1 MHz, and a loss tangent of 0.02 at 1 MHz. The rubber material has a dielectric constant in the range of 2.0 to 3.5 and a loss tangent in the range of 0.005 to 0.019 at 1 MHz. The rubber material includes, but not limited to, santoprene, polypropylene, and polystyrene. The one or more antenna arms includes a first antenna arm configured to communicate signals in a first frequency band, and a second antenna arm configured to communicate signals in a second frequency band. The mobile device can be worn as at least one of collar, wrist, ankle, and waist band, and it can be used to monitor location of a patient in a hospital, location of a child in a park, location of a child in school, or location of a pet.

In yet another embodiment, a method for creating a multiband antenna is described. The method provides a ground plane, a ground plane extension, and a plurality antenna arms. The ground plane may be located in a first enclosure, the ground plane extension and the plurality of antenna arms may be located in a second enclosure. The method forms the second enclosure to create a separation between the multiband antenna and a user.

The method uses the ground plane of the multiband antenna as an addition shield for a printed circuit board in the first enclosure. Alternatively, the method uses a ground plane of a printed circuit board as the ground plane of the multiband antenna. In some implementations, the method connects the ground plane and the ground plane extension directly. In some other implementations, the method couples the ground plane and the ground plane extension using one or more controllable connectors, wherein the one or more controllable connectors are configured to connect or disconnect the ground plane extension from the ground plane.

The method etches the ground plane, the ground plane extension, and the plurality of antenna arms on a flexible material. Then, the method places a first section of the flexible material including the ground plane into the first enclosure, molds a second section of the flexible material including the ground plane extension and a third section of the flexible material including the plurality of antenna arms into a thermoplastic elastomer of the second enclosure.

The method tunes a first antenna arm to communicate signals in a first frequency band, tunes a second antenna arm to communicate signals in a second frequency band, and tunes a third antenna arm to communicate signals in a third frequency band.

BRIEF DESCRIPTION OF THE DRAWINGS

The aforementioned features and advantages of the disclosure, as well as additional features and advantages thereof, will be more clearly understandable after reading detailed descriptions of embodiments of the disclosure in conjunction with the following drawings.

Like numbers are used throughout the figures.

DESCRIPTION OF EMBODIMENTS

Embodiments of a multiband antenna for a mobile device are disclosed. The following descriptions are presented to enable any person skilled in the art to make and use the disclosure. Descriptions of specific embodiments and applications are provided only as examples. Various modifications and combinations of the examples described herein will be readily apparent to those skilled in the art, and the general principles defined herein may be applied to other examples and applications without departing from the spirit and scope of the disclosure. Thus, the present disclosure is not intended to be limited to the examples described and shown, but is to be accorded the widest scope consistent with the principles and features disclosed herein.

Figure 1A:
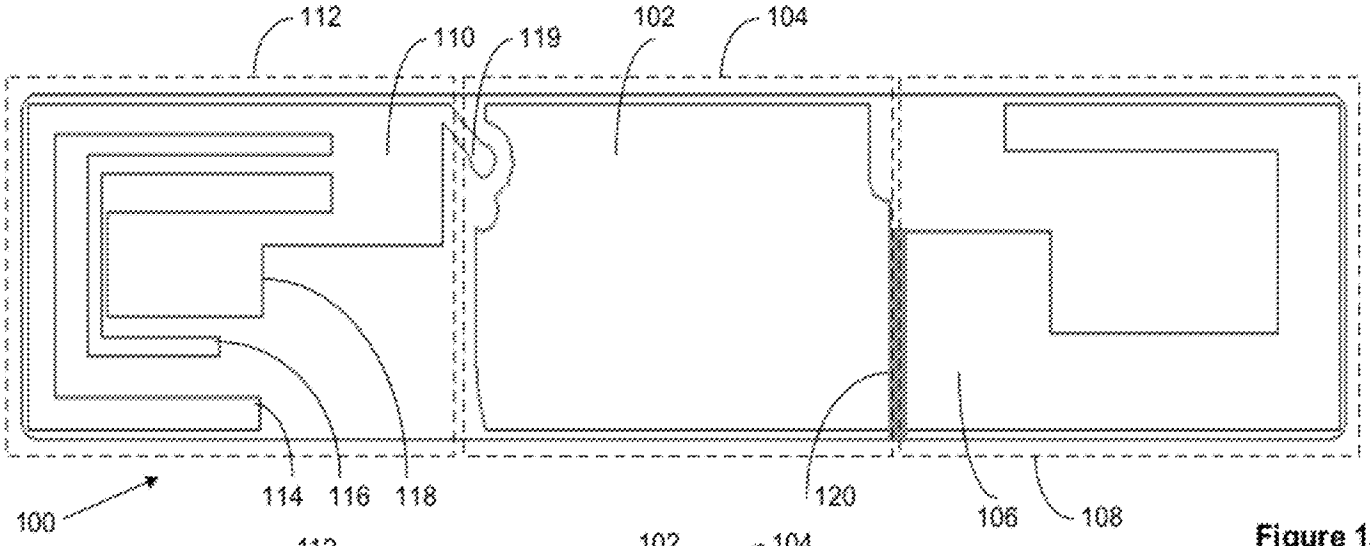
FIGS. 1*a*-1*b* illustrate a multiband antenna according to some aspects of the present disclosure.
Figure 1B:
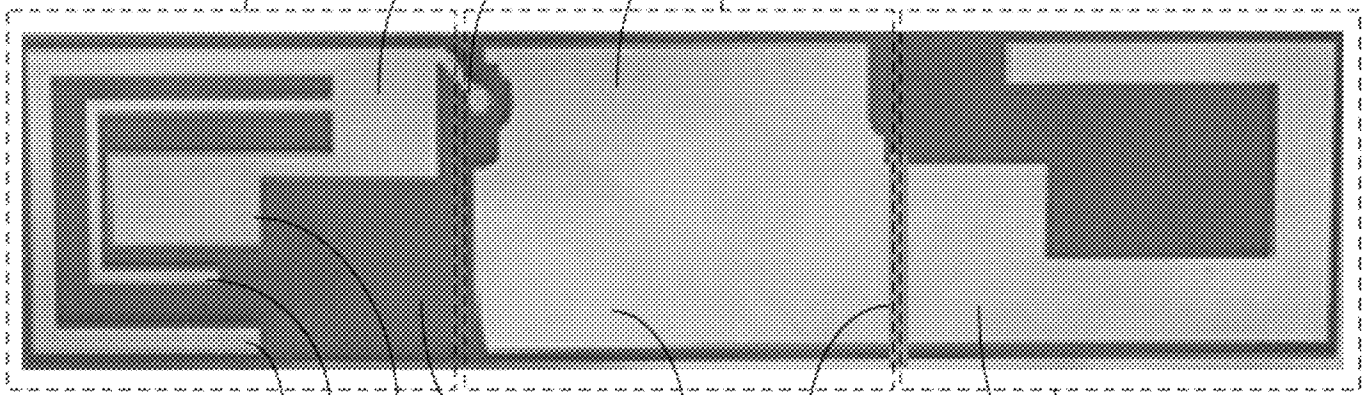

FIGS. 1*a*-1*b* illustrate a multiband antenna according to some aspects of the present disclosure. In the example shown in FIG. 1*a*, a multiband antenna 100 includes a first section 102, a second section 106, and a third section 110, where each section may be located in an enclosure (shown by the dotted rectangular line), such as 104, 108, and 112 respectively. The first section 102 may implement a ground plane and the second section 106 may implement an extension ground plane of the multiband antenna 100.

The multiband antenna further includes one or more connectors 120 (shown as a grey strip) that can be selectively turned on or turned off, thus enabling adjustment of the connectivity between the ground plane in the first section 102 and the ground plane extension in the second section 106 of the multiband antenna 100. In this approach, the ground plane and the extended ground plane can be selectively connected and adjusted to increase the size of the ground plane, which in turn enables a higher radiated performance of the multiband antenna 100 than using the ground plane in the first section 102 alone. The one or more controllable connectors 120 can be implemented in a controller on a printed circuit board (PCB, also known as printed wired board, PWB) or on a flexible printed circuit board. For example, the one or more controllable connectors 120 may be implemented with transistors, which can be controlled to be turned on or off. In another approach, the one or more controllable connectors 120 may be implemented with radio frequency (RF) switches or electromagnetic switches, thus controlling the connectivity between the ground plane in the first section 102 and the ground plane extension in the second section 106 of the multiband antenna 100.

In one approach, the ground plane of a PCB located within the enclosure 104 may be used as the ground plane of the first section 102 of the multiband antenna 100. It is coupled to and controlled by a RF circuit of a controller on the PCB. In a second approach, the first section 102 of the multiband antenna 100 may be implemented using an additional piece of copper coupled (via a pogo pin, not shown) to the ground plane of the PCB located within the enclosure 104. In the second approach, a larger combined ground plane is formed, and the influence due to the characteristics of the PCB may be reduced. The larger combined ground plane is coupled to and controlled by a RF circuit of a controller on the PCB. Thus, this approach enables better control of signal quality of the antenna. In this case, the ground plane of the first section 102 may be used as an additional shield for electronic components of the PCB. The enclosure 104 also includes an extension connector 119 for connecting the parallel antenna arms in enclosure 112 to a RF circuit on a printed circuit board in enclosure 104. In alternate embodiments, other types of connectors, including but not limited to pogo pins, antenna clips and spring clips, can be used for connecting the parallel antenna arms to a RF circuit on a printed circuit board.

The third section 110 includes three parallel antenna arms 114, 116, and 118. In one exemplary implementation, the antenna arm 114 may be tuned to transmit or receive signals in the Cell band (824-894 MHz) and ISM band (902-928 MHz); the antenna arm 116 may be tuned to transmit or receive signals in the GPS band (1565-1585 MHz); and the antenna arm 118 may be tuned to transmit or receive signals in the PCS band (1850-1990 MHz). In alternative embodiments, one or more antenna arms may be implemented instead of the three parallel antenna arms shown in FIG. 1*a*. The three antenna arms 114, 116 and 118, the ground plane 102, and the ground plane extension 106 are configured to communicate signals in the Cell, ISM, GPS and PCS bands by passing a current from the ground plane 102 and the ground plane extension 106 to the three parallel antenna arms 114, 116, and 118 to generate signals in the form of electromagnetic waves.

According to embodiments of the present disclosure, the antenna arm 114 can be tuned to a length proportional to approximately a quarter wavelength of a frequency in the Cell and ISM bands, the antenna arm 116 can be tuned to a length proportional to approximately a quarter wavelength of a frequency in the GPS bands, and the antenna arm 118 can be tuned to a length proportional to approximately a quarter wavelength of a frequency in the PCS band. In addition, the ground plane 102 and the ground plane extension 106 can be tuned to have a length proportional to approximately a quarter wavelength of a frequency in the multiple frequency bands supported by the antenna arms, such as a frequency in the Cell and ISM band. In some approaches, approximately a quarter wavelength may be within a range (such as within plus or minus 5%, 10%, 20%, etc.) from the quarter wavelength as specified by designer of the multiband antenna.

Referring to FIG. 1*b*, it shows an implementation of the multiband antenna of FIG. 1*a* (not to scale). In this implementation, the multiband antenna 100 can be fabricated with a conductive material 122, such as copper, to implement the ground plane in the first section 102, the extended ground plane in the second section 106, and the three parallel antenna arms 114, 116, and 118 in the third section 110 of the multiband antenna 100. Person skilled in the art would understand that other conductive materials, including but not limited to gold, may be used in place of copper. In addition, the multiband antenna 100 can be fabricated on a flexible material 124 and be mold injected into enclosures of particular form and shape, where the enclosures may be made of rubber type of material.

In one implementation, Pyralux® copper-clad laminated composites, also referred to as laminate flex, can be used as the flexible material 124. In this example, the Pyralux® copper-clad laminated composites can be made of DuPont™ Kapton® polyimide film with copper foil on one side bonded to the polyimide film with acrylic adhesive. Specifically, the LF9120R Pyralux® copper-clad laminated composites can be used, which has thickness of approximately 4 mil (1 mil=0.001 inch), a dielectric constant of approximately 3.6 at 1 MHz, and a loss tangent of approximately 0.02 at 1 MHz. In the example shown in FIG. 1*b*, the ground plane, the ground plane extension, and the one or more antenna arms may be etched onto a single piece of laminate flex. And then the laminate flex may be molded into a thermoplastic elastomer. In another approach, each of the ground plane, the ground plane extension, and the one or more antenna arms may be etched onto separate pieces of laminate flex, and then each piece of the laminate flex may be placed in different enclosures. For example, the laminate flex contains the ground plane extension may be placed into one enclosure, and the laminate flex contains the one or more antenna arms may be placed into another enclosure. In yet another approach, each of the ground plane, the ground plane extension, and the one or more antenna arms may be etched onto separate pieces of laminate flex, and then the laminate flex contains the ground plane may be placed into a first enclosure, and the laminate flex contains the ground plane extension and the laminate flex contains the one or more antenna arms may be placed into a second enclosure.

Figure 1C:
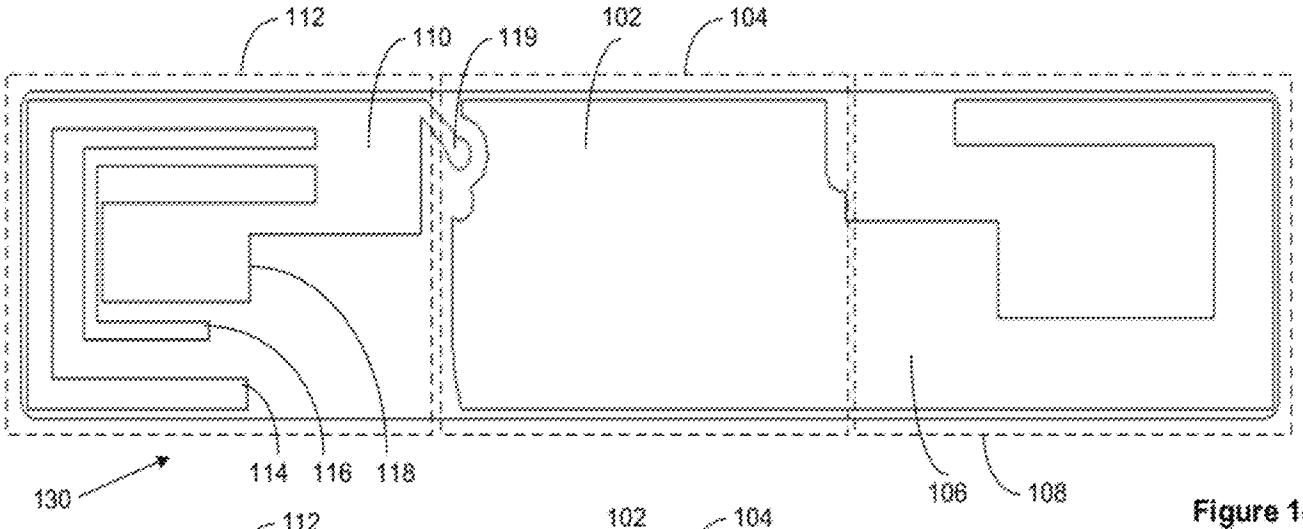
FIGS. 1*c*-1*d* illustrate another multiband antenna according to some aspects of the present disclosure.
Figure 1D:
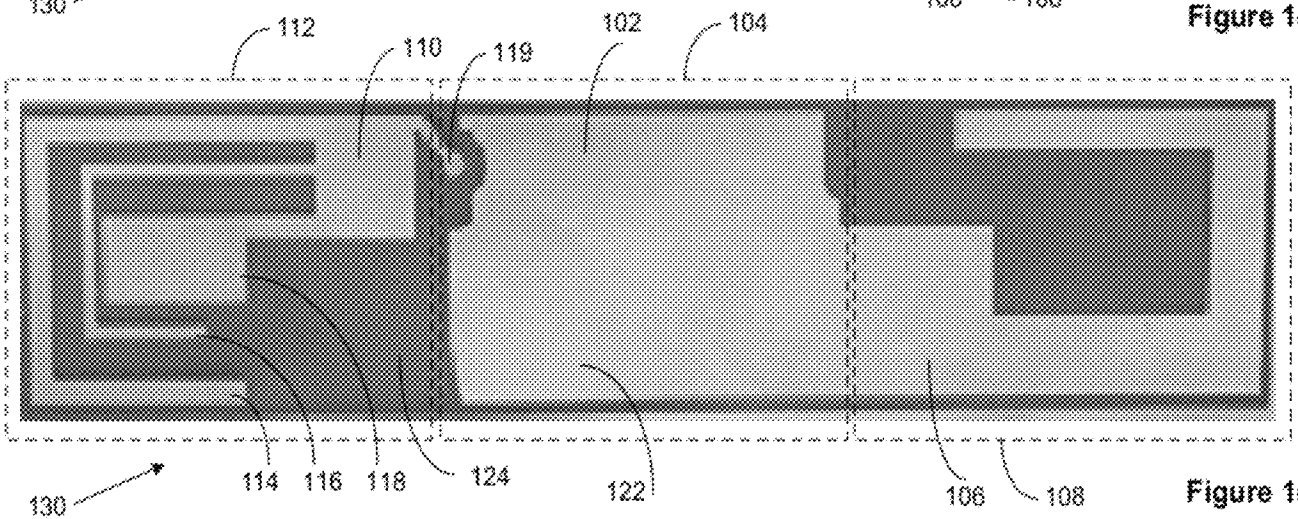
Figure 1E:
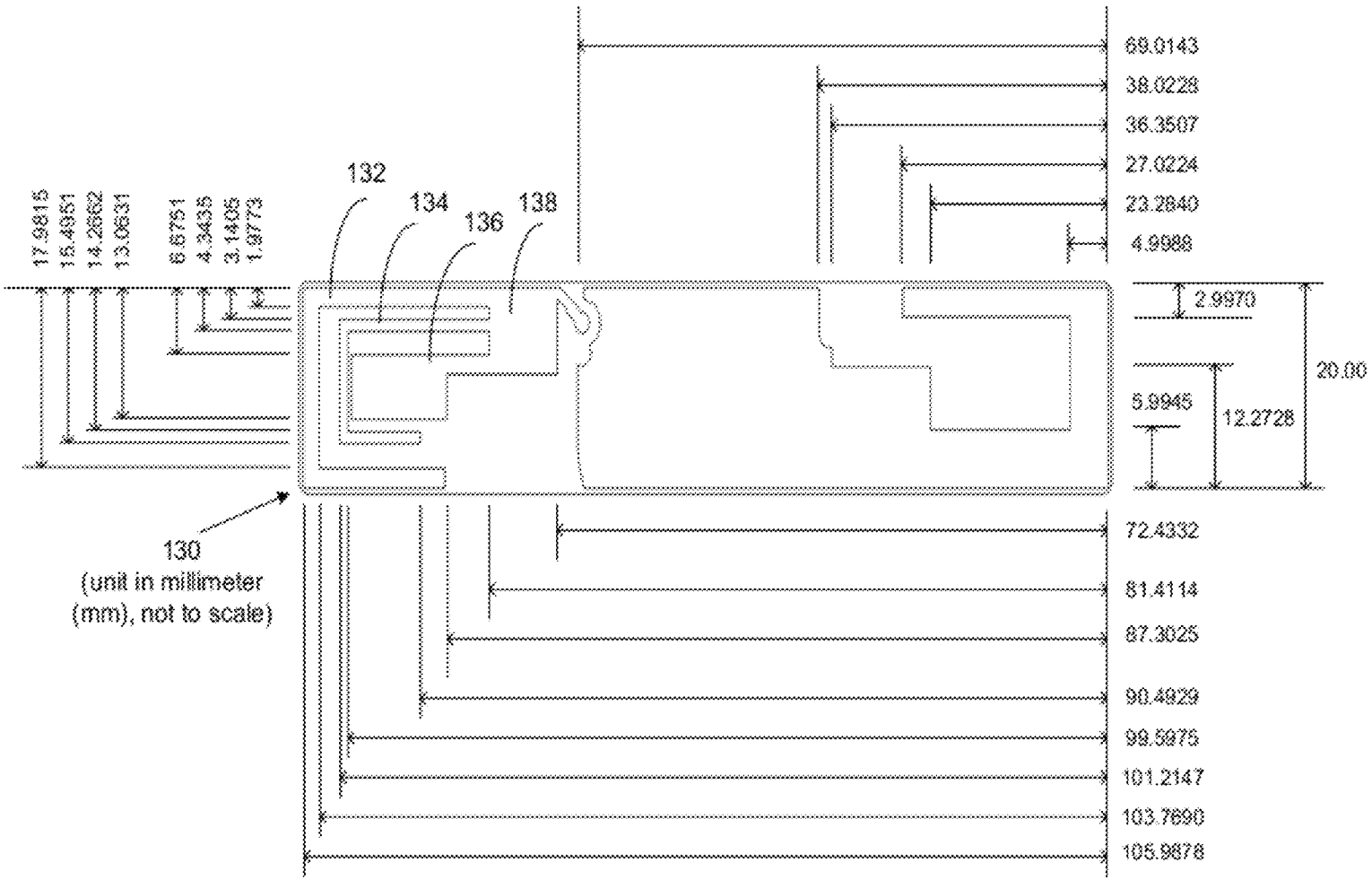
FIG. 1*e* illustrates dimensions of the multiband antenna of FIG. 1*c* according to some aspects of the present disclosure.

FIGS. 1*c*-1*d* illustrates another multiband antenna according to some aspects of the present disclosure. The multiband antenna 130 shown in FIG. 1*c* is similar to the multiband antenna 100 shown in FIG. 1*a*, except that the first section 102 and the second section 106 may be directly connected such that there can be no controllable connector between these two sections. In this implementation, the ground plane and the extended ground plane can be directly connected to increase the size of the ground plane, which in turn enables a higher radiated performance of the multiband antenna 130 than using the ground plane in the first section 102 alone. Similarly, FIG. 1*d* shows an implementation of the multiband antenna 130 of FIG. 1*c* (not to scale). FIG. 1*e* illustrates dimensions of the multiband antenna of FIG. 1*c* according to some aspects of the present disclosure. Note that the unit measure of FIG. 1*e* is in millimeter (mm), and the figure is not drawn to scale. As shown in FIG. 1*e*, the first antenna arm 132 has approximately a first u-shape with a first section of approximately 24.58 mm in length and 1.98 mm in width, a second section of approximately 17.98 mm in length and 2.22 mm in width, and a third section of approximately 18.69 mm in length and 1.98 mm in width. The second antenna arm 134 has approximately a second u-shape with a first section of approximately 18.19 mm in length and 1.20 mm in width, a second section of approximately 12.36 mm in length and 1.61 mm in width, and a third section of approximately 10.72 mm in length and 1.20 mm in width. The third antenna arm 136 has approximately a rectangular shape with approximately 12.30 mm in length and 6.39 mm in width. The plurality of antenna arms has a base 138 having approximately a rectangular shape with approximately 8.98 mm in length and 7.73 mm in width.

In another implementation, the multiband antenna can be made using conductive ink. The method is to spray the conductive ink onto plastic or rubber carrier(s) according to the pattern and dimensions of the multiband antenna designs shown in FIG. 1*a*, FIG. 1*c* and FIG. 1*e*, for example. In this method, no copper or flexible material is used and the conductive ink forms the ground plane, the ground plane extension, the parallel antenna arms, and other parts of the multiband antenna.

In yet another implementation, the multiband antenna can be made using stamped metal parts heat-staked to plastic carriers. The stamped metal part is used to make the multiband antenna according to the pattern and dimensions of the multiband antenna designs shown in FIG. 1*a*, FIG. 1*c* and FIG. 1*e*, on a metal plate. The metal plate can be copper or other metals with the good conductivity, for example. After the metal plated multiband antenna is made, it can be attached to plastic by heat staking. If the enclosure is not plastic but rubber, the metal plated multiband antenna can be mold-injected into the rubber in the same way as the copper-clad laminated flexible material described above.

Figure 2A:
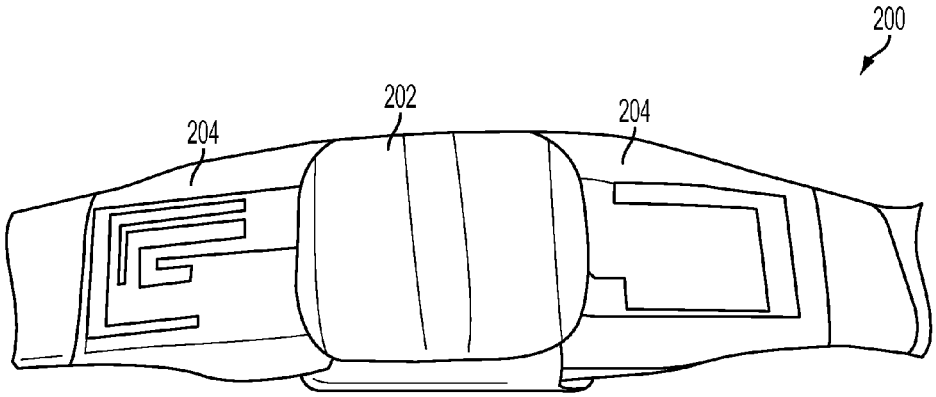
FIG. 2*a* illustrates a design of enclosures for a multiband antenna according to some aspects of the present disclosure.

FIG. 2*a* illustrates a design of enclosures for a multiband antenna according to some aspects of the present disclosure. As shown in FIG. 2*a*, the multiband antenna 200 can be located in two separate enclosures, namely 202 and 204. In this example, the ground plane is located in the enclosure 202, the extended ground plane and the antenna arms are located in the enclosure 204. A thermoplastic elastomer material can be used for the enclosure 204 of the multiband antenna. According to some aspects of the disclosure, a dielectric constant of the thermoplastic elastomer material can be in the range of 2.0-3.5; and a loss tangent of the thermoplastic elastomer material can be in the range of 0.005-0.019. Other materials may be used for the enclosure of 204, including but not limited to, santoprene 101-80 (also known as thermoplastic vulcanizate), polypropylene, and polystyrene. It is beneficial to have the extended ground plane and the antenna arms located in the wings of the multiband antenna 200, extending the size of the antenna outside of the enclosure 202. In this way, the design reduces the size of the rigid structure of the multiband antenna 200 to the middle section (202) and yet provides a relatively larger size multiband antenna for higher radiated performance of the antenna.

Figure 2B:
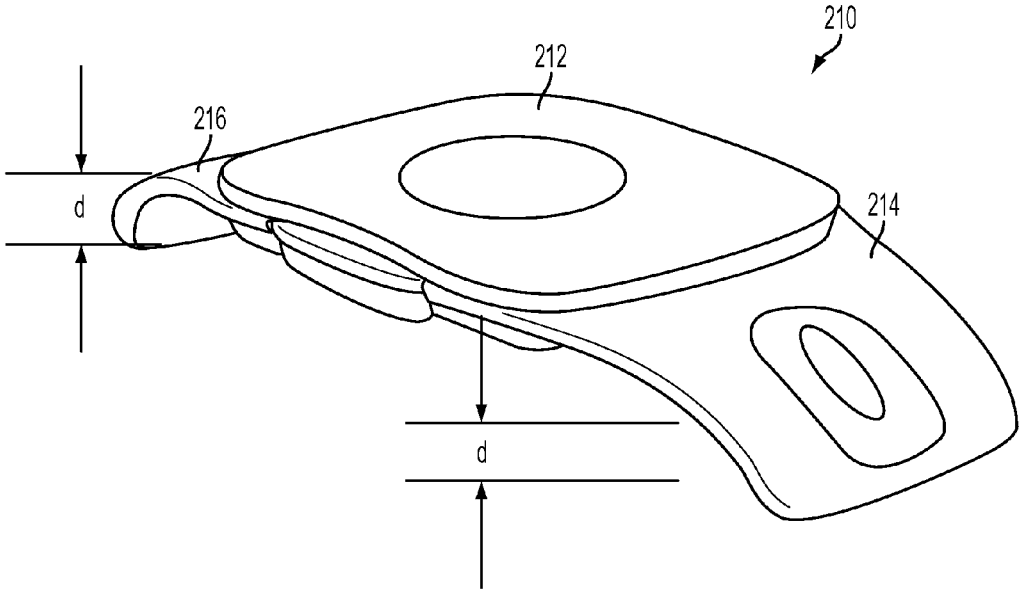
FIG. 2*b* illustrates another design of enclosures for a multiband antenna according to some aspects of the present disclosure.

FIG. 2*b* illustrates another design of enclosures for a multiband antenna according to some aspects of the present disclosure. As shown in FIG. 2*b*, the multiband antenna 210 can be located in three separate enclosures, namely 212, 214, and 216. In this example, the ground plane is located in the enclosure 212, the extended ground plane is located in the enclosure 214, and the antenna arms are located in the enclosure 216. In addition, the multiband antennas of the present disclosure can have curved wings such that a separation denoted as distance d, can be created between the multiband antenna and the surface of a pet or human body. According to some aspects, the separation distance may be in the range of 1 to 15 millimeters (mm) It is beneficial to have a separation between the multiband antenna and the surface of the pet or human body. By creating this separation distance, signal loss due to conductivity of the pet or human body can be reduced, which is further discussed in association with FIG. 5*a*-5*c*.

According to aspects of the present disclosure, the multiband antenna for a mobile device may be worn on the collar of a pet and thus be used to track the location of the pet. In other embodiments, the multiband antenna for a mobile device may be worn on a person, including but not limited to as a collar, wrist, ankle, or waist band. For example, the mobile device may be worn by a child in an amusement park so that the location of the child can be monitored. For another example, the mobile device may be worn by a patient in a hospital so that the location of the patient can be monitored.

Note that FIG. 1*b*, FIG. 1*d*, FIG. 2*a*, FIG. 2*b* and their corresponding descriptions provide means for providing a ground plane located in a first enclosure, means for providing a ground plane extension located in a second enclosure, and means for providing a plurality antenna arms located in a third enclosure. FIG. 1*e*, FIG. 4, FIG. 5*a*-5*c* and their corresponding descriptions provide means for tuning a first antenna arm to communicate signals in a first frequency band, means for tuning a second antenna arm to communicate signals in a second frequency band, and means for tuning a third antenna arm to communicate signals in a third frequency band.

Figure 3:
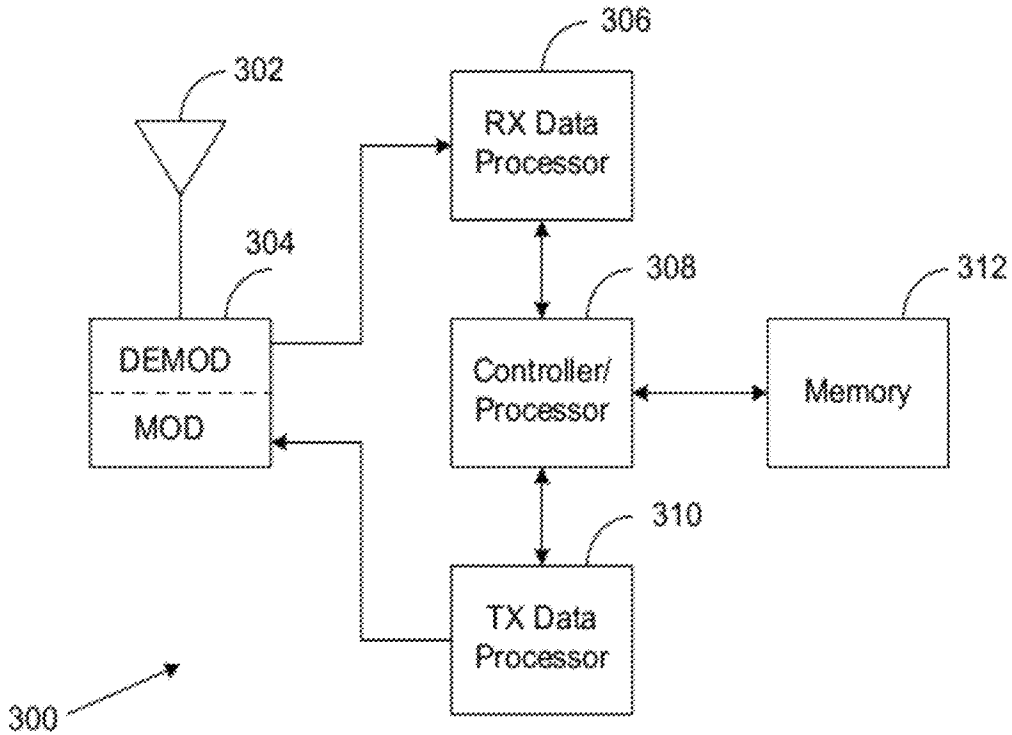
FIG. 3 illustrates a block diagram of a mobile device with a multiband antenna according to some aspects of the present disclosure.

FIG. 3 illustrates a block diagram of a mobile device with a multiband antenna according to some aspects of the present disclosure. At the mobile device 300, multiband antenna 302 receives modulated signals from a base station and provides the received signals to a demodulator (DEMOD) part of a modem 304. The demodulator processes (e.g., conditions and digitizes) the received signal and obtains input samples. It further performs orthogonal frequency-division multiplexing (OFDM) demodulation on the input samples and provides frequency-domain received symbols for all subcarriers. An RX data processor 306 processes (e.g., symbol de-maps, de-interleaves, and decodes) the frequency-domain received symbols and provides decoded data to a controller/processor 308 of the mobile device 300.

The controller/processor 308 then generates various types of signaling for the multiband antenna mobile device 300. A TX data processor 310 generates signaling symbols, data symbols, and pilot symbols, which can be processed by modulator (MOD) of modem 304 and transmitted via the multiband antenna 302 to a base station. In addition, the controller/processor 308 directs the operation of various processing units at the multiband antenna mobile device 300. Memory 312 stores program codes and data for the multiband antenna mobile device 300.

Figure 4:
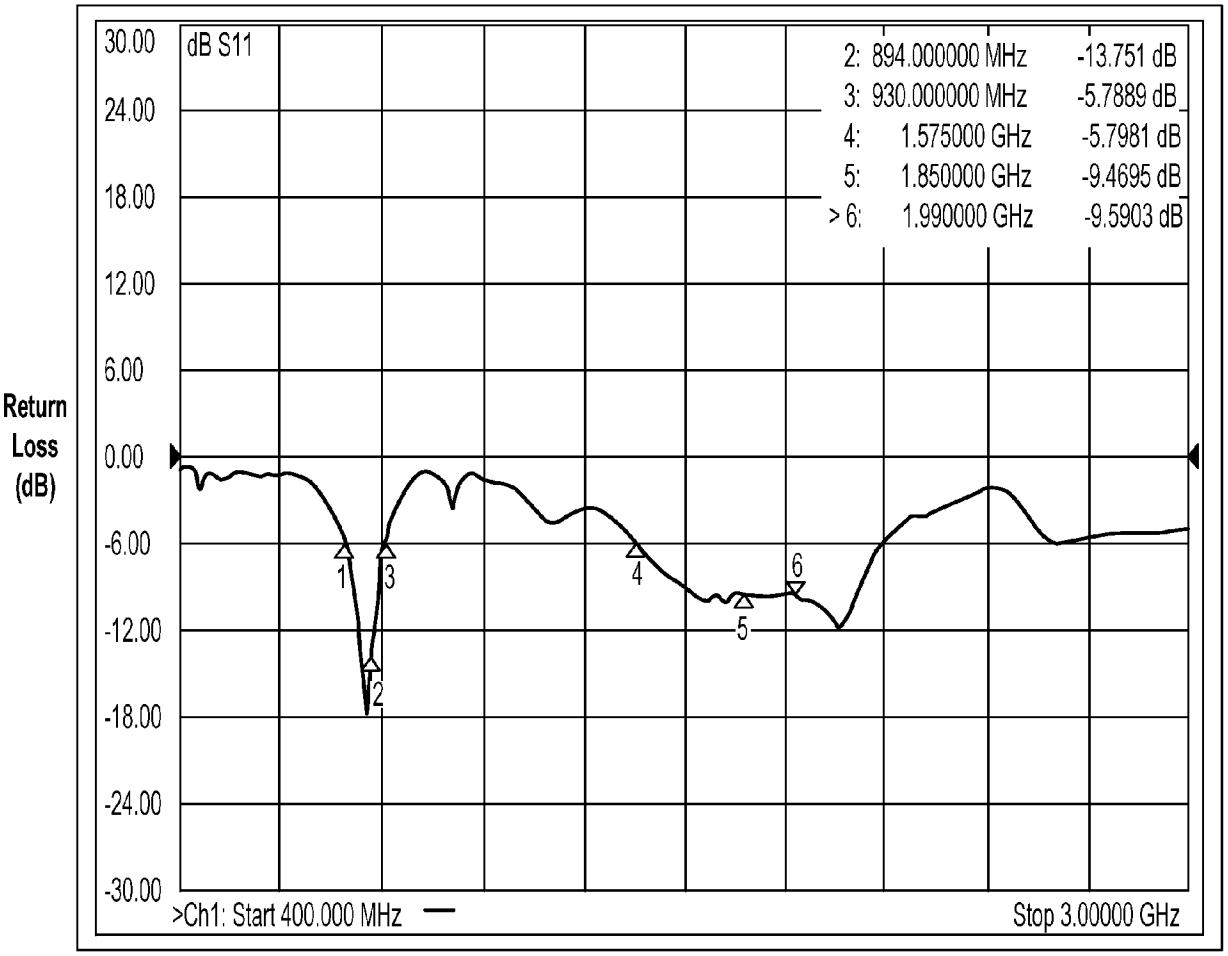
FIG. 4 illustrates a graph of return loss data versus frequency according to some aspects of the present disclosure.

FIG. 4 illustrates a graph of return loss data versus frequency according to some aspects of the present disclosure. In this example, the ground plane, the ground plane extension, and the one or more antenna arms of the multiband antenna are adjusted to minimize the return loss data in each of the desired frequency range to be operated by the multiband antenna. The multiband antenna radiating element includes multiple copper traces connected in parallel, enabling the antenna to operate for multiple frequency bands as each copper trace can be tuned for specific frequency band by adjusting the length and other dimensions of the trace. In general, a longer copper trace corresponds to a lower operating frequency. However, when multiple copper traces are located in close proximity of each other, there can be coupling effect between the different copper traces. To design an antenna with multiple antenna arms, the separation (gap) between each copper trace, the length of each copper trace, and the width of each copper trace may be adjusted to achieve a desired result. Note that the separation can affect the capacitance of the antenna while the length and width can affect the inductance of the antenna. When the distance between traces is smaller, the capacitance between the traces is higher. When the length of a trace is longer or the width of a trace is larger, the inductance of the trace is higher. To design the multiband antenna, separation between copper traces, length, and width of each copper trace can be adjusted to achieve a desirable antenna performance.

As shown in FIG. 4, the return loss data is below −6 dB between markers 1 and 3, which cover the frequency ranges of the cell and ISM bands; the return loss data is below −6 dB at markers 4, which is the operating frequency of the GPS band; the return loss data is approximately about −9 dB between markers 5 and 6, which cover the frequency ranges of the PCS bands.

Figure 5A:
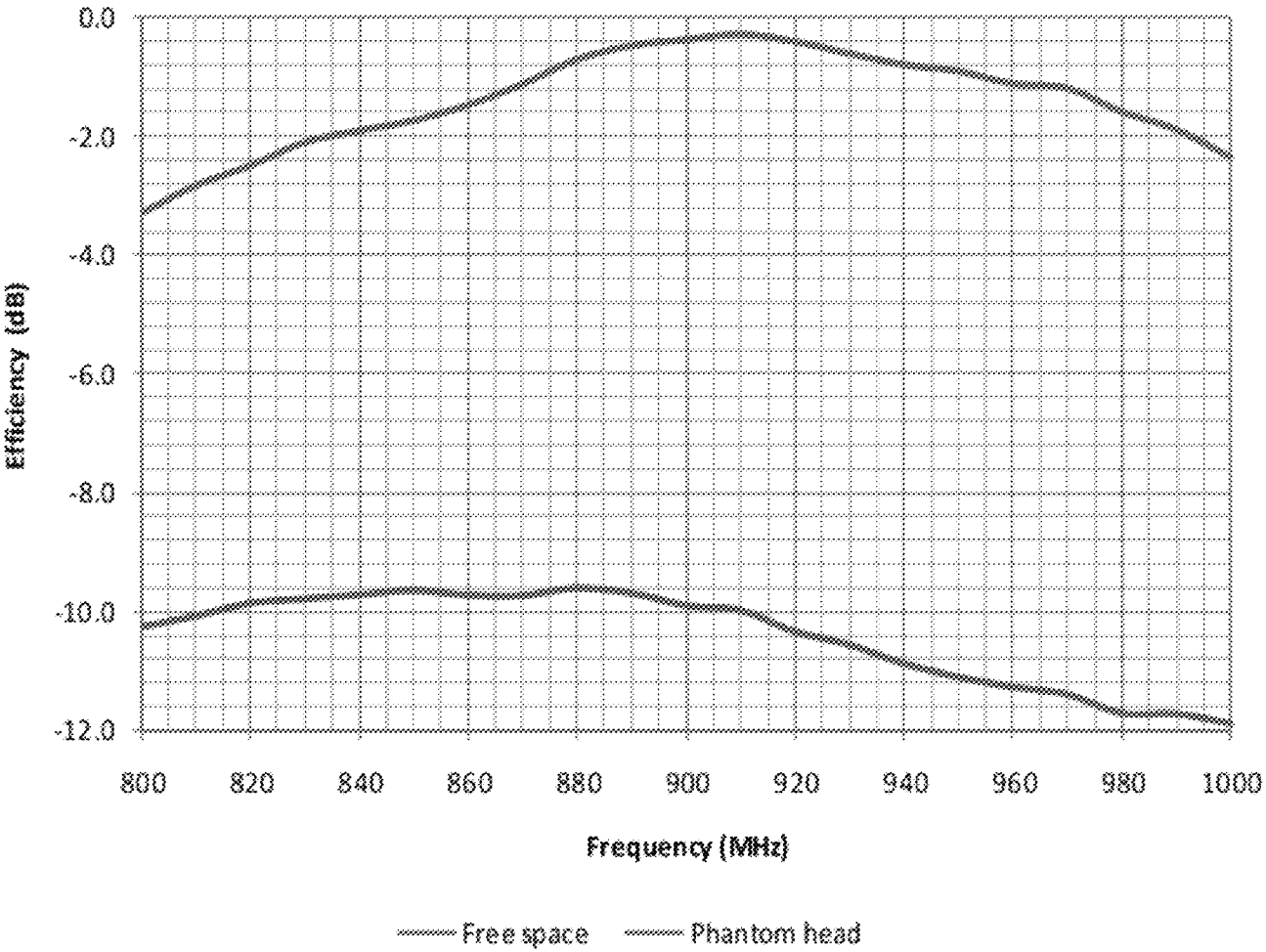
FIG. 5*a* illustrates antenna efficiency of the multiband antenna of FIG. 1*c* in cell and ISM bands according to some aspects of the present disclosure.

FIG. 5*a* illustrates antenna efficiency of the multiband antenna of FIG. 1*c* in cell and ISM bands according to some aspects of the present disclosure. As shown in FIG. 5*a*, the vertical axis represents the antenna efficiency of the multiband antenna measured in dB, and the horizontal axis represents transmission frequency of the multiband antenna in MHz. The upper line represents the efficiency of the multiband antenna in free space and the lower line represents the efficiency of the multiband antenna with a simulated pet or human head (also referred to as the phantom head). In this example, the efficiency of the multiband antenna in free space can be better than −2.5 dB; and the efficiency of the multiband antenna with a simulated pet or human head can be about −10 dB.

Figure 5B:
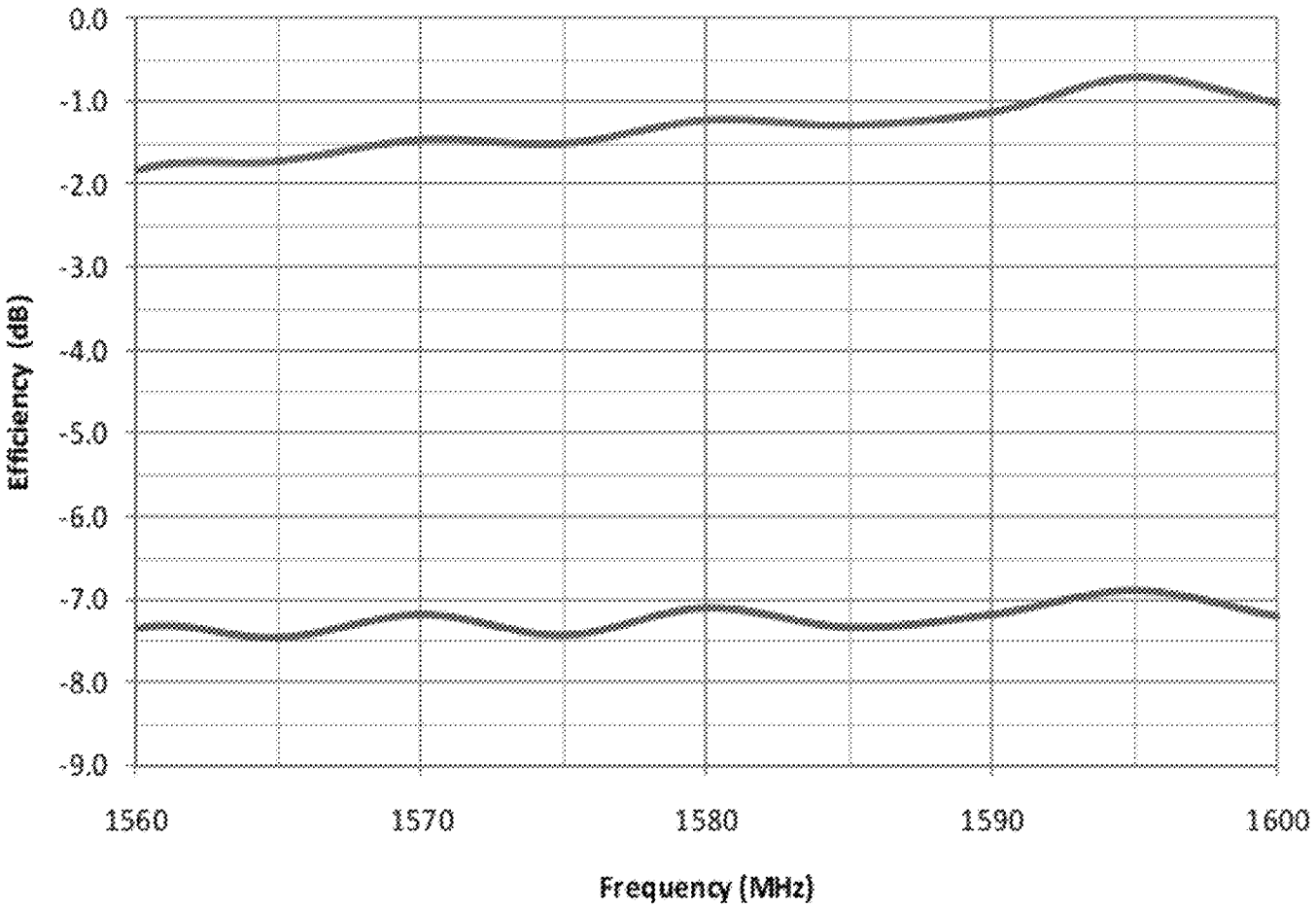
FIG. 5*b* illustrates antenna efficiency of the multiband antenna of FIG. 1*c* in GPS band according to some aspects of the present disclosure.

FIG. 5*b* illustrates antenna efficiency of the multiband antenna of FIG. 1*c* in GPS band according to some aspects of the present disclosure. Similar to FIG. 5*a*, the vertical axis represents the antenna efficiency of the multiband antenna measured in dB, and the horizontal axis represents transmission frequency of the multiband antenna in MHz. The upper line represents the efficiency of the multiband antenna in free space and the lower line represents the efficiency of the multiband antenna with a simulated pet or human head. In this example, the efficiency of the multiband antenna in free space can be better than −1.5 dB; and the efficiency of the multiband antenna with a simulated pet or human head can be mostly between −7 dB to −7.5 dB.

Figure 5C:
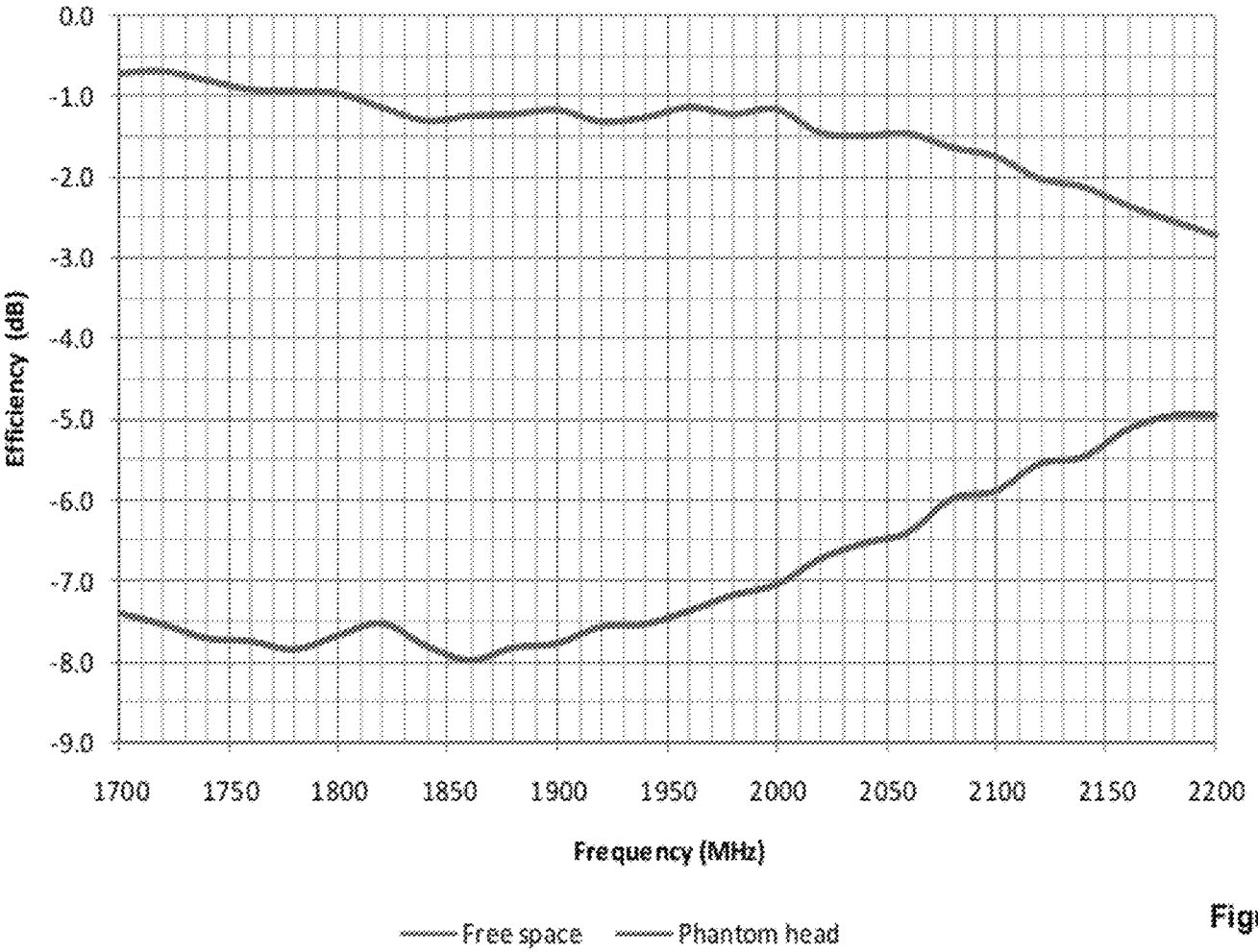
FIG. 5*c* illustrates antenna efficiency of the multiband antenna of FIG. 1*c* in PCS band according to some aspects of the present disclosure.

FIG. 5*c* illustrates antenna efficiency of the multiband antenna of FIG. 1*c* in PCS band according to some aspects of the present disclosure. Similar to FIG. 5*a*, the vertical axis represents the antenna efficiency of the multiband antenna measured in dB, and the horizontal axis represents transmission frequency of the multiband antenna in MHz. The upper line indicates the efficiency of the multiband antenna in free space and the lower line indicates the efficiency of the multiband antenna with a simulated pet or human head. In this example, the efficiency of the multiband antenna in free space can be better than −1.5 dB; and the efficiency of the multiband antenna with a simulated pet or human head can be about −8 dB.

The methodologies described herein can be implemented by various means depending upon the application. For example, these methodologies can be implemented in hardware, firmware, software, or a combination thereof. For a hardware implementation, the processing units can be implemented within one or more application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, electronic devices, other electronic units designed to perform the functions described herein, or a combination thereof Herein, the term "control logic" encompasses logic implemented by software, hardware, firmware, or a combination.

For a firmware and/or software implementation, the methodologies can be implemented with modules (e.g., procedures, functions, and so on) that perform the functions described herein. Any machine readable medium tangibly embodying instructions can be used in implementing the methodologies described herein. For example, software codes can be stored in a memory and executed by a processing unit. Memory can be implemented within the processing unit or external to the processing unit. As used herein the term "memory" refers to any type of long term, short term, volatile, nonvolatile, or other storage devices and is not to be limited to any particular type of memory or number of memories, or type of media upon which memory is stored.

If implemented in firmware and/or software, the functions may be stored as one or more instructions or code on a computer-readable medium. Examples include computer-readable media encoded with a data structure and computer-readable media encoded with a computer program. Computer-readable media may take the form of an article of manufacturer. Computer-readable media includes physical computer storage media. A storage medium may be any available medium that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to store desired program code in the form of instructions or data structures and that can be accessed by a computer; disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media.

In addition to storage on computer readable medium, instructions and/or data may be provided as signals on transmission media included in a communication apparatus. For example, a communication apparatus may include a transceiver having signals indicative of instructions and data. The instructions and data are configured to cause one or more processors to implement the functions outlined in the claims. That is, the communication apparatus includes transmission media with signals indicative of information to perform disclosed functions. At a first time, the transmission media included in the communication apparatus may include a first portion of the information to perform the disclosed functions, while at a second time the transmission media included in the communication apparatus may include a second portion of the information to perform the disclosed functions.

The disclosure may be implemented in conjunction with various wireless communication networks such as a wireless wide area network (WWAN), a wireless local area network (WLAN), a wireless personal area network (WPAN), and so on. The terms "network" and "system" are often used interchangeably. The terms "position" and "location" are often used interchangeably. A WWAN may be a Code Division Multiple Access (CDMA) network, a Time Division Multiple Access (TDMA) network, a Frequency Division Multiple Access (FDMA) network, an Orthogonal Frequency Division Multiple Access (OFDMA) network, a Single-Carrier Frequency Division Multiple Access (SC-FDMA) network, a Long Term Evolution (LTE) network, a WiMAX (IEEE 802.16) network and so on. A CDMA network may implement one or more radio access technologies (RATs) such as cdma2000, Wideband-CDMA (W-CDMA), and so on. Cdma2000 includes IS-95, IS2000, and IS-856 standards. A TDMA network may implement Global System for Mobile Communications (GSM), Digital Advanced Mobile Phone System (D-AMPS), or some other RAT. GSM and W-CDMA are described in documents from a consortium named "3rd Generation Partnership Project" (3GPP). Cdma2000 is described in documents from a consortium named "3rd Generation Partnership Project 2" (3GPP2). 3GPP and 3GPP2 documents are publicly available. A WLAN may be an IEEE 802.11x network, and a WPAN may be a Bluetooth network, an IEEE 802.15x, or some other type of network. The techniques may also be implemented in conjunction with any combination of WWAN, WLAN and/or WPAN.

A mobile station refers to a device such as a cellular or other wireless communication device, personal communication system (PCS) device, personal navigation device (PND), Personal Information Manager (PIM), Personal Digital Assistant (PDA), laptop or other suitable mobile device which is capable of receiving wireless communication and/or navigation signals. The term "mobile station" is also intended to include devices which communicate with a personal navigation device (PND), such as by short-range wireless, infrared, wire line connection, or other connection—regardless of whether satellite signal reception, assistance data reception, and/or position-related processing occurs at the device or at the PND. Also, "mobile station" is intended to include all devices, including wireless communication devices, computers, laptops, etc. which are capable of communication with a server, such as via the Internet, Wi-Fi, or other network, and regardless of whether satellite signal reception, assistance data reception, and/or position-related processing occurs at the device, at a server, or at another device associated with the network. Any operable combination of the above are also considered a "mobile station."

Designation that something is "optimized," "required" or other designation does not indicate that the current disclosure applies only to systems that are optimized, or systems in which the "required" elements are present (or other limitation due to other designations). These designations refer only to the particular described implementation. Of course, many implementations are possible. The techniques can be used with protocols other than those discussed herein, including protocols that are in development or to be developed.

Aspects of the present disclosure have disclosed a multiband antenna for a tracking device. The antenna with or without the tracking device may be attached to an object or attached via an intermediary to an object, for example a person or a pet. Examples of an intermediary are a pet collar or a wrist band. The multi-band antenna may be a three or more band antennas. The band may operate at a number of different frequencies, examples include the Cell band (824-894 MHz), GPS band (1565-1585 MHz), PCS band (1850-1990 MHz), or ISM band (902-928 MHz). The frequencies of the bands may also differ depending on the technology. The tracking device may be a LDC, GPS, or InGeo. The antenna may be made from santoprene enclosure with an embedded flex circuit. Other materials may include, but are not limited to, thermoplastic elastomer, ployimide film, or copper foil. In one example, the antenna design is a flex-type antenna, wherein the antenna pattern is etched on a laminate flex which may be mold injected to the thermoplastic elastomer.

One skilled in the relevant art will recognize that many possible modifications and combinations of the disclosed embodiments may be used, while still employing the same basic underlying mechanisms and methodologies. The foregoing description, for purposes of explanation, has been written with references to specific embodiments. However, the illustrative discussions above are not intended to be exhaustive or to limit the disclosure to the precise forms disclosed. Many modifications and variations are possible in view of the above teachings. The embodiments were chosen and described to explain the principles of the disclosure and their practical applications, and to enable others skilled in the art to best utilize the disclosure and various embodiments with various modifications as suited to the particular use contemplated.

We claim:

1. A multiband antenna, comprising:

a ground plane;

a ground plane extension; and a plurality of antenna arms, wherein the ground plane, the ground plane extension, and the plurality of antenna arms are configured to communicate signals in multiple frequency bands, and wherein the ground plane and the ground plane extension have a length proportional to approximately a quarter wavelength of a frequency in the multiple frequency bands, and wherein the plurality of antenna arms comprises:

a first antenna arm configured to communicate signals in a first frequency band;

a second antenna arm configured to communicate signals in a second frequency band; and a third antenna arm configured to communicate signals in a third frequency band, wherein the first frequency band includes Cell and ISM bands, and the first antenna arm has a length proportional to approximately a quarter wavelength of a frequency in the Cell and ISM bands;

the second frequency band includes GPS band , and the second antenna arm has a length proportional to approximately a quarter wavelength of a frequency in the GPS bands; and the third frequency band includes PCS band, and the third antenna arm has a length proportional to approximately a quarter wavelength of a frequency in the PCS band.

2. A multiband antenna, comprising:

a ground plane;

a ground plane extension; and a plurality of antenna arms, wherein the ground plane, the ground plane extension, and the plurality of antenna arms are configured to communicate signals in multiple frequency bands, and wherein the ground plane and the ground plane extension have a length proportional to approximately a quarter wavelength of a frequency in the multiple frequency bands, and wherein the plurality of antenna arms comprises:

a first antenna arm configured to communicate signals in a first frequency band;

a second antenna arm configured to communicate signals in a second frequency band; and a third antenna arm configured to communicate signals in a third frequency band, wherein the first antenna arm has approximately a first u-shape with a first section of approximately 24.58 mm in length and 1.98 mm in width, a second section of approximately 17.98 mm in length and 2.22 mm in width, and a third section of approximately 18.69 mm in length and 1.98 mm in width;

the second antenna arm has approximately a second u-shape with a first section of approximately 18.19 mm in length and 1.20 mm in width, a second section of approximately 12.36 mm in length and 1.61 mm in width, and a third section of approximately 10.72 mm in length and 1.20 mm in width;

the third antenna arm has approximately a rectangular shape with approximately 12.30 mm in length and 6.39 mm in width; and wherein the plurality of antenna arms has a base having approximately a rectangular shape with approximately 8.98 mm in length and 7.73 mm in width.

3. A multiband antenna, comprising:

a ground plane;

a ground plane extension; and a plurality of antenna arms, wherein the ground plane, the ground plane extension, and the plurality of antenna arms are configured to communicate signals in multiple frequency bands, and wherein the ground plane and the ground plane extension have a length proportional to approximately a quarter wavelength of a frequency in the multiple frequency bands, wherein the ground plane, the ground plane extension and the plurality of antenna arms are etched on a flexible material; wherein a first section of the flexible material including the ground plane is placed into the first enclosure, a second section of the flexible material including the ground plane extension and a third section of the flexible material including the plurality of antenna arms are molded into a thermoplastic elastomer of the second enclosure.

4. A multiband antenna, comprising:

a ground plane;

a ground plane extension; and a plurality of antenna arms, wherein the ground plane, the ground plane extension, and the plurality of antenna arms are configured to communicate signals in multiple frequency bands, and wherein the ground plane and the ground plane extension have a length proportional to approximately a quarter wavelength of a frequency in the multiple frequency bands, wherein the ground plane is located in a first enclosure, the ground plane extension is located in a second enclosure, and the plurality of antenna arms are located in a third enclosure, and further wherein the ground plane, the ground plane extension and the plurality of antenna arms are etched on a flexible material; wherein a first section of the flexible material including the ground plane is placed into the first enclosure, a second section of the flexible material including the ground plane extension is molded into a thermoplastic elastomer of the second enclosure, and a third section of the flexible material including the plurality of antenna arms is molded into a thermoplastic elastomer of the third enclosure.

5. A mobile device, comprising:

a multiband antenna configured to communicate signals in multiple frequency bands, wherein the multiband antenna includes a ground plane, a ground plane extension, and a plurality of antenna arms, and wherein the ground plane and the ground plane extension have a length proportional to approximately a quarter wavelength of a frequency in the multiple frequency bands, wherein the plurality of antenna arms comprises a first antenna arm configured to communicate signals in a first frequency band; a second antenna arm configured to communicate signals in a second frequency band; and a third antenna arm configured to communicate signals in a third frequency band;

a modem (modulator and demodulator) configured to modulate signal for transmission and demodulate signal received from the base station;

a controller configured to control communication of signals using the multiband antenna and the modem, wherein the first frequency band includes Cell and ISM bands, and the first antenna arm has a length proportional to approximately a quarter wavelength of a frequency in the Cell and ISM bands;

the second frequency band includes GPS band, and the second antenna arm has a length proportional to approximately a quarter wavelength of a frequency in the GPS bands; and the third frequency band includes PCS band, and the third antenna arm has a length proportional to approximately a quarter wavelength of a frequency in the PCS band.

6. A mobile device, comprising:

a multiband antenna configured to communicate signals in multiple frequency bands, wherein the multiband antenna includes a ground plane, a ground plane extension, and a plurality of antenna arms, and wherein the ground plane and the ground plane extension have a length proportional to approximately a quarter wavelength of a frequency in the multiple frequency bands;

a modem (modulator and demodulator) configured to modulate signal for transmission and demodulate signal received from the base station; and a controller configured to control communication of signals using the multiband antenna and the modem, wherein the ground plane is located in a first enclosure; the ground plane extension and the plurality of antenna arms are located in a second enclosure, and further wherein the ground plane, the ground plane extension and the plurality of antenna arms are etched on a flexible material; wherein a first section of the flexible material including the ground plane is placed into the first enclosure, a second section of the flexible material including the ground plane extension and a third section of the flexible material including the plurality of antenna arms are molded into a thermoplastic elastomer of the second enclosure.

7. A method for creating a multiband antenna, comprising:

providing a ground plane;

providing a ground plane extension;

providing a plurality antenna arms, wherein the ground plane, the ground plane extension, and the plurality of antenna arms are configured to communicate signals in multiple frequency bands, and wherein the ground plane and the ground plane extension have a length proportional to approximately a quarter wavelength of a frequency in the multiple frequency bands, wherein providing the plurality of antenna arms comprises:

tuning a first antenna arm to communicate signals in a first frequency band;

tuning a second antenna arm to communicate signals in a second frequency band; and tuning a third antenna arm to communicate signals in a third frequency band.

8. A method for creating a multiband antenna, comprising:

providing a ground plane;

providing a ground plane extension;

providing a plurality antenna arms, wherein the ground plane, the ground plane extension, and the plurality of antenna arms are configured to communicate signals in multiple frequency bands, and wherein the ground plane and the ground plane extension have a length proportional to approximately a quarter wavelength of a frequency in the multiple frequency bands, wherein the ground plane is located in a first enclosure; the ground plane extension and the plurality of antenna arms are located in a second enclosure, further comprising:

etching the ground plane, the ground plane extension and the plurality of antenna arms on a flexible material;

placing a first section of the flexible material including the ground plane into the first enclosure; and molding a second section of the flexible material including the ground plane extension and a third section of the flexible material including the plurality of antenna arms into a thermoplastic elastomer of the second enclosure.

* * * * *